US009850742B2

(12) United States Patent
Beck et al.

(10) Patent No.: US 9,850,742 B2
(45) Date of Patent: Dec. 26, 2017

(54) RECLOSABLE SLEEVE ASSEMBLY AND METHODS FOR ISOLATING HYDROCARBON PRODUCTION

(75) Inventors: Adam Beck, Flower Mound, TX (US); Tom Swan, Parker, TX (US); Robert L. Thurman, Frisco, TX (US); Ellen Thurman, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 401 days.

(21) Appl. No.: 14/423,731

(22) PCT Filed: Aug. 29, 2012

(86) PCT No.: PCT/US2012/052735

§ 371 (c)(1),
(2), (4) Date: Apr. 15, 2015

(87) PCT Pub. No.: WO2014/035383

PCT Pub. Date: Mar. 6, 2014

(65) Prior Publication Data

US 2015/0233210 A1 Aug. 20, 2015

(51) Int. Cl.
*E21B 34/14* (2006.01)
*E21B 34/00* (2006.01)

(52) U.S. Cl.
CPC ..... *E21B 34/14* (2013.01); *E21B 2034/007* (2013.01)

(58) Field of Classification Search
CPC ..... E21B 34/14; E21B 34/102
See application file for complete search history.

(56) References Cited

U.S. PATENT DOCUMENTS 4,429,747 A * 2/1984 Williamson, Jr. .... E21B 34/103 166/321
5,343,949 A * 9/1994 Ross ..... E21B 17/07 166/278
5,368,098 A * 11/1994 Blizzard, Jr. ..... E21B 33/127 166/100
5,597,042 A 1/1997 Tubel et al.
(Continued)

FOREIGN PATENT DOCUMENTS

CA WO 2012024773 A1 * 3/2012 ..... E21B 21/103
WO 9747850 A1 12/1997

OTHER PUBLICATIONS

International Search Report and Written Opinion for PCT/US2012/052735 dated Mar. 27, 2013.

*Primary Examiner* — Jennifer H Gay
(74) *Attorney, Agent, or Firm* — McDermott Will & Emery LLP

(57) ABSTRACT

Disclosed is reclosable sleeve assembly including a housing defining one or more flow ports that provide fluid communication between a wellbore annulus and an interior of the housing, an outer sleeve arranged within the housing and movable between a closed position, where the outer sleeve occludes the one or more flow ports, and an open position, where the one or more flow ports are exposed, and an inner sleeve concentrically arranged within the outer sleeve and defining a plurality of flow slots, the inner sleeve being movable between an open position and a closed position where, when in the open position, the plurality of flow slots are axially aligned with the one or more flow ports.

20 Claims, 4 Drawing Sheets

(56) References Cited

U.S. PATENT DOCUMENTS 5,609,178 A 3/1997 Hennig et al.
5,890,537 A 4/1999 Lavaure et al.
6,293,342 B1 * 9/2001 McGarian ..... E21B 21/10 166/317
6,397,949 B1 6/2002 Walker et al.
6,422,317 B1 * 7/2002 Williamson, Jr. ..... E21B 34/10 166/320
6,571,875 B2 6/2003 Bissonnette et al.
6,725,937 B1 * 4/2004 McHardy ..... E21B 21/103 166/334.4
2004/0244976 A1 12/2004 Turner et al.
2008/0001111 A1 * 1/2008 Ross ..... E21B 23/04 251/230
2009/0095486 A1 * 4/2009 Williamson, Jr. .... E21B 21/103 166/373
2010/0000727 A1 1/2010 Webb et al.
2010/0224371 A1 * 9/2010 Swan ..... E21B 21/103 166/373
2011/0100643 A1 * 5/2011 Themig ..... E21B 34/102 166/373
2011/0108272 A1 * 5/2011 Watson ..... E21B 34/103 166/271
2011/0278017 A1 * 11/2011 Themig ..... E21B 34/14 166/373
2012/0012322 A1 1/2012 Korkmaz et al.
2012/0279723 A1 * 11/2012 Hofman ..... E21B 34/063 166/373
2013/0056206 A1 * 3/2013 Jackson ..... E21B 34/102 166/281
2013/0168098 A1 * 7/2013 Campbell ..... E21B 34/14 166/308.1
2013/0319767 A1 * 12/2013 Wilson ..... E21B 21/10 175/24
2014/0076578 A1 * 3/2014 Hofman ..... E21B 34/10 166/373
2014/0083708 A1 * 3/2014 Beck ..... E21B 43/26 166/308.1
2015/0233210 A1 * 8/2015 Beck ..... E21B 34/14 166/373

* cited by examiner

RECLOSABLE SLEEVE ASSEMBLY AND METHODS FOR ISOLATING HYDROCARBON PRODUCTION

BACKGROUND

The present invention relates to equipment utilized in subterranean well operations and, more particularly, to a reclosable sleeve assembly and methods for isolating hydrocarbon production within a well.

Hydrocarbon-producing wells are often stimulated by one or more hydraulic fracturing operations which generally include injecting a fracturing fluid into a subterranean formation penetrated by a wellbore at a hydraulic pressure sufficient to create or enhance at least one fracture therein. One of the purposes of the fracturing process is to increase formation conductivity so that the greatest possible quantity of hydrocarbons from the formation can be extracted/produced into the penetrating wellbore.

In some wells, it may be desirable to selectively create multiple fractures along a wellbore at predetermined distances apart from each other, thereby creating multiple "pay zones" from which hydrocarbons can be intelligently produced. A series of actuatable sleeve assemblies may be arranged within the downhole completion assembly in order to separate the pay zones for intelligent production. These sleeve assemblies have devices movably arranged therein generally known as sliding sleeves or sliding side doors due to the ability of the devices to shift an inner sleeve from a first position to a second position. Shifting these inner sleeves allow the operator at the surface to initiate hydrocarbon production, cease hydrocarbon production, or generally regulate hydrocarbon production through the sleeve assembly at that particular location.

Actuating a sleeve downward within the sleeve assembly serves to reveal one or more flow ports that, once exposed, allow the influx of fluids into the production tubing. In conventional actuated sleeve assemblies, the sleeve is not designed to retract into the closed position in order to close the flow ports and thereby cease hydrocarbon production at that location. Instead, a tool, such as a side door choke, is typically run into the sleeve assembly to occlude the flow ports and provide a permanent installation within the production tubing. While effective in sealing the flow ports and ceasing hydrocarbon production at that location, the side door choke adversely reduces the inner diameter of the production tubing at that location which, in turn, reduces the potential flow rate through the production tubing. A reduced inner diameter of the production tubing also adversely affects the size of the downhole tools that can be extended past the sleeve assembly, which are thereafter required to be of smaller diameters. Thus, there is a need for a reclosable sleeve assembly that does not disadvantageously reduce the inner diameter of the production tubing but nonetheless is effective in ceasing hydrocarbon production through the one or more flow ports.

SUMMARY OF THE INVENTION

The present invention relates to equipment utilized in subterranean well operations and, more particularly, to a reclosable sleeve assembly and methods for isolating hydrocarbon production within a well.

In some aspects of the disclosure, a sleeve assembly is disclosed. The sleeve assembly may include a housing having an uphole end and a downhole end and defining one or more flow ports that provide fluid communication between a wellbore annulus and an interior of the housing, the housing being coupled to a top sub at the uphole end and to a bottom sub at the downhole end, an outer sleeve arranged within the housing and movable between a closed position, where the outer sleeve occludes the one or more flow ports, and an open position, where the one or more flow ports are exposed, and an inner sleeve concentrically arranged within the outer sleeve and defining a plurality of flow slots, the inner sleeve being movable between an open position and a closed position where, when in the open position, the plurality of flow slots are axially aligned with the one or more flow ports.

In other aspects of the disclosure, a method of actuating a sleeve assembly installed in production tubing is disclosed. The method may include introducing a first shifting tool into the sleeve assembly, the sleeve assembly including a housing defining one or more flow ports, an outer sleeve arranged within the housing such that the one or more flow ports are exposed, and an inner sleeve concentrically arranged within the outer sleeve and defining a plurality of flow slots, wherein the plurality of flow slots are axially aligned with the one or more flow ports, thereby providing fluid communication between a wellbore annulus and an interior of the sleeve assembly, engaging the first shifting tool on a first radial shoulder defined on the inner sleeve, and axially moving the inner sleeve with the first shifting tool such that the plurality of flow slots are moved out of axial alignment with the one or more flow ports.

In yet other aspects of the disclosure, another sleeve assembly is disclosed. The sleeve assembly may include a housing defining one or more flow ports that provide fluid communication between a wellbore annulus and an interior of the housing, the housing being configured to be coupled at each end to production tubing, an outer sleeve arranged within the housing and movable between a closed position, where the outer sleeve occludes the one or more flow ports, and an open position, where the one or more flow ports are exposed, an inner sleeve concentrically arranged within the outer sleeve and defining a plurality of flow slots, the inner sleeve being movable between an open position and a closed position where, when in the open position, the plurality of flow slots are axially aligned with the one or more flow ports, a piston movably arranged within a piston bore defined in the housing, a spring arranged within the piston bore and configured to bias an uphole end of the piston, and an upper locking device arranged within a first cavity defined in the piston and movable therewith, the upper locking device being engageable with an outer radial surface of the outer sleeve such that as the spring biases against and axially moves the piston within the piston bore, the upper locking device engages and simultaneously moves the outer sleeve into its open position.

The features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present invention relates to equipment utilized in subterranean well operations and, more particularly, to a reclosable sleeve assembly and methods for isolating hydrocarbon production within a well.

One advantage provided by the disclosed exemplary sleeve assembly is that, opposed to the bulky side door choke typically used to occlude the flow ports, the exemplary sleeve assembly includes an inner sleeve that is able to cover its flow ports without adversely reducing the inner diameter of the production tubing. As a result, the flow rate through the production tubing is largely unaffected and downhole tools that must traverse the sleeve assembly are therefore not required to exhibit a reduced diameter. An additional advantage of the exemplary sleeve assembly is the ability to close and reopen the sleeve assembly. For instance, in some applications, for various reasons it may be advantageous to close the sleeve assembly and thereby cease production at that location for a predetermined period of time and then reopen the sleeve assembly at a later time in order to recommence production.

Figure 1:
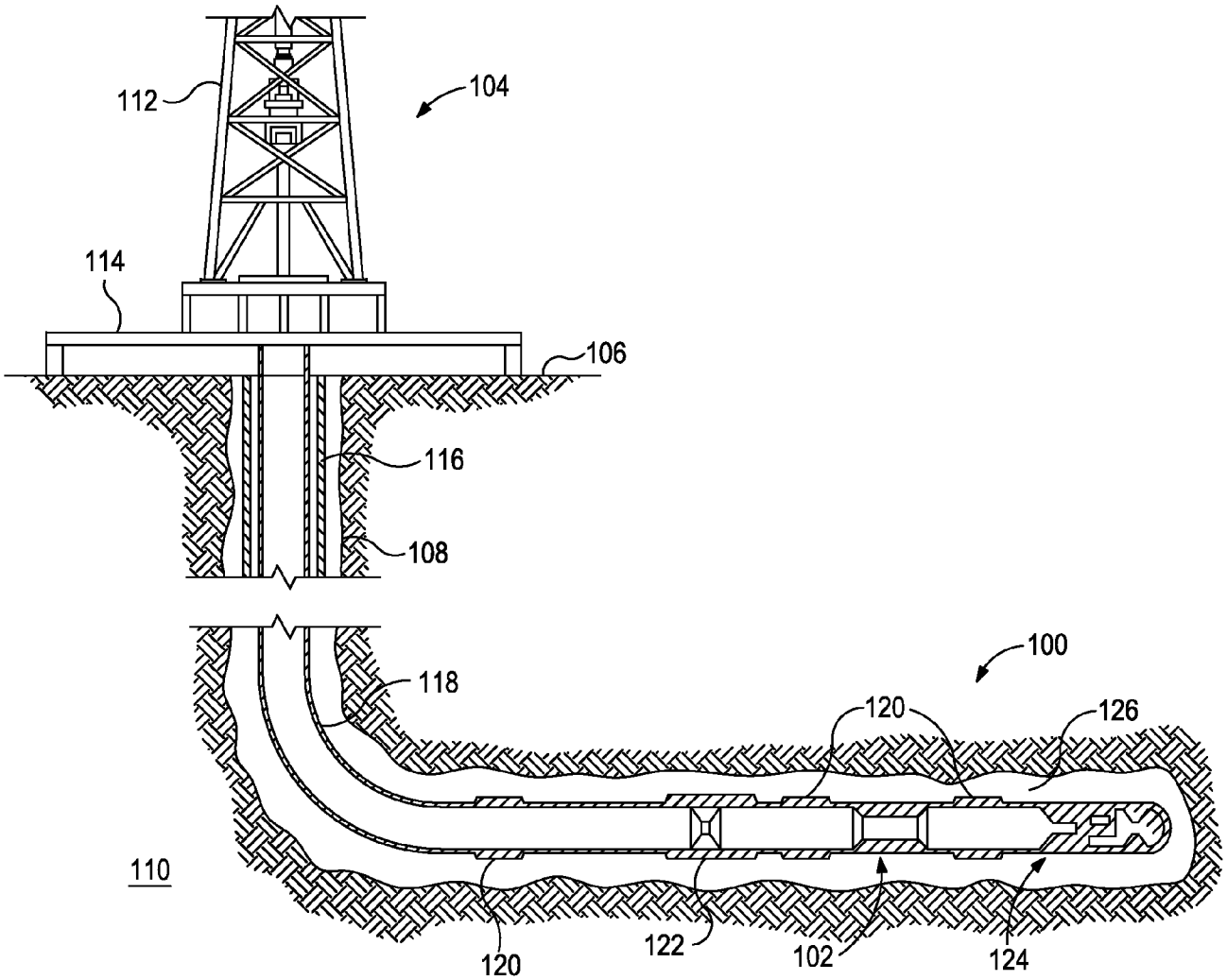
FIG. 1 illustrates a well system employing one or more exemplary sleeve assemblies, according to one or more embodiments.

Referring to FIG. 1, illustrated is a well system 100 that may employ one or more exemplary sleeve assemblies 102 as disclosed herein, according to one or more embodiments. As depicted, the system 100 may include a drilling or servicing rig 104 that is positioned on the Earth's surface 106 and extends over and around a wellbore 108 that penetrates a subterranean formation 110 for the purpose of recovering hydrocarbons. The wellbore 108 may be drilled into the subterranean formation 110 using any suitable drilling technique known to those skilled in the art. In an embodiment, the drilling or servicing rig 104 includes a derrick 112 with a rig floor 114. A casing string 116 may extend from the surface 106 and be cemented into an upper portion of the wellbore 108. In some embodiments, lower portions of the wellbore 108 may be cemented or uncemented, without departing from the scope of the disclosure. While the rig 104 is depicted in FIG. 1 as a land-based facility, it may equally be located at any geographical location. Accordingly, the drilling or servicing rig 104 may be, for example, an offshore rig or drilling platform, without departing from the scope of the disclosure.

The wellbore 108 may extend substantially vertically away from the surface 106 over a vertical wellbore portion, or may deviate at any angle from the surface 106 over a deviated or horizontal wellbore portion. In other well systems 100, portions or substantially all of the wellbore 108 may be vertical, deviated, horizontal, and/or curved. It is noted that although FIG. 1 depicts horizontal and vertical portions of the wellbore 108, the principles of the systems and methods disclosed herein are applicable to any type of wellbore 108 configuration. Accordingly, the horizontal or vertical nature of any figure is not to be construed as limiting the wellbore 108, or the use of a sleeve assembly 102 therein, to any particular configuration.

Production tubing 118 may extend from the rig floor 114 and into the wellbore 108 and casing string 116. The production tubing 118 provides a conduit for formation fluids to travel from the formation 110 to the surface 106. As illustrated, in one or more embodiments, the exemplary sleeve assembly 102 may be incorporated within the production tubing 118 at some part thereof. While only one sleeve assembly 102 is shown in FIG. 1, it will be appreciated that more than one sleeve assembly 102 may be employed in any given well system 100, without departing from the scope of the disclosure. In some embodiments, the well system 100 may further include one or more packers 120 configured to provide fluid seals between the production tubing 118 and the wellbore 108, thereby defining various production intervals or pay zones. The well system 100 may also include one or more manipulatable servicing tools 122 and a float shoe 124. A wellbore annulus 126 is defined between the production tubing 118 and the wellbore 108, and in operation formation fluids, or other fluids disposed in the formation 110, escape into the wellbore annulus 126 and are extracted therefrom via the one or more sleeve assemblies 102, as will be described in more detail below.

The drilling or servicing rig 104 may be conventional and may comprise a motor driven winch and other associated equipment for lowering the production tubing 118 into the wellbore 108, thereby positioning the sleeve assembly 102 and other wellbore servicing equipment at the desired depth. While the well system 100 depicted in FIG. 1 refers to a stationary drilling or servicing rig 104 for lowering and setting the production tubing 118 within a land-based wellbore 108, one of ordinary skill in the art will readily appreciate that mobile workover rigs, offshore rigs and platforms, wellbore servicing units (e.g., coiled tubing units), and the like may be used to lower the production tubing 118, and accompanying sleeve assembly 102, into the wellbore 108. Accordingly, it should be understood that the various disclosed embodiments of the sleeve assembly 102 may equally be used in other operational environments, such as within an offshore wellbore operational environment.

Moreover, use of directional terms such as above, below, upper, lower, upward, downward, uphole, downhole, and the like are used in relation to the illustrative embodiments as they are depicted in the figures, the upward or uphole direction being toward the left of the corresponding figure and the downward or downhole direction being toward the right of the corresponding figure, the uphole direction being toward the surface of the well and the downhole direction being toward the toe or bottom of the well.

Figure 2A:
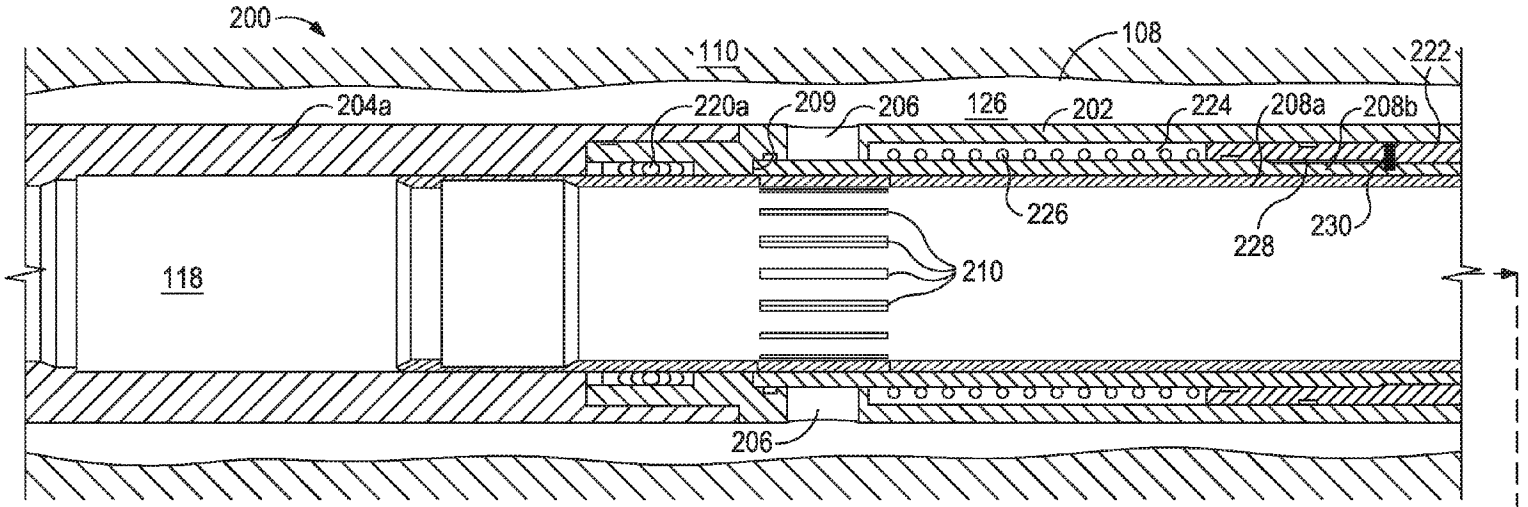
FIGS. 2A and 2B illustrate a partial cross-sectional view of an exemplary sleeve assembly, according to one or more embodiments.
Figure 2B:
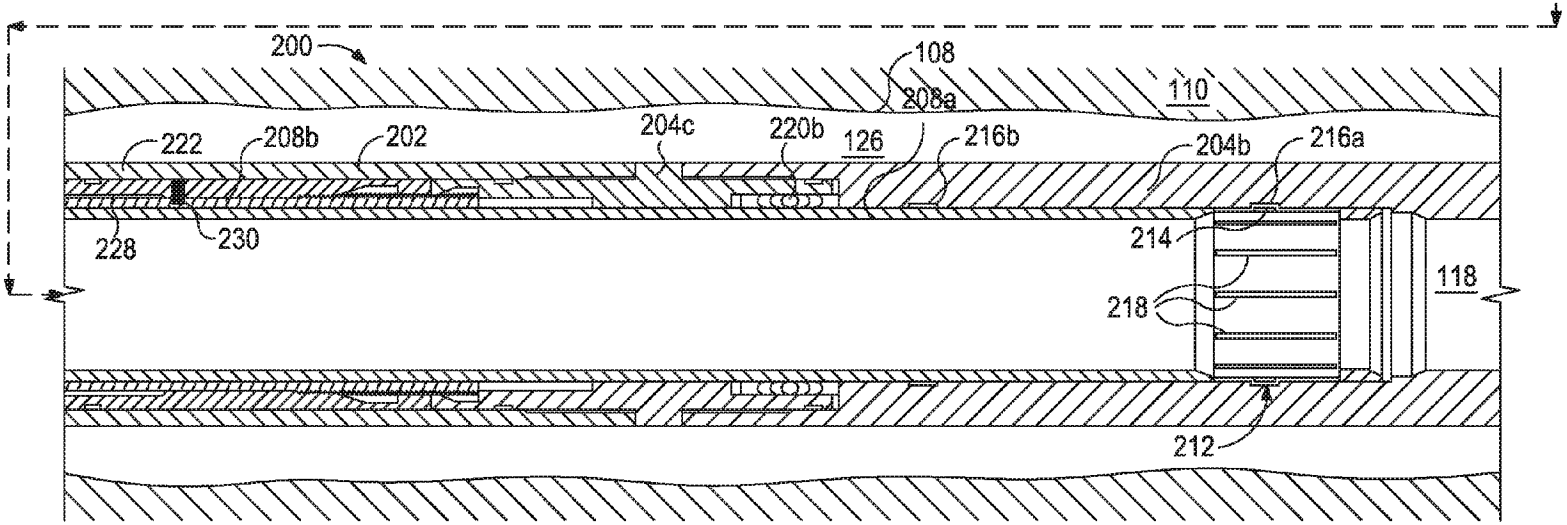

Referring now to FIGS. 2A and 2B, with continued reference to FIG. 1, illustrated is a partial cross-sectional view of an exemplary sleeve assembly 200, according to one or more embodiments. Specifically, FIG. 2A illustrates an upper portion of the sleeve assembly 200 and FIG. 2B illustrates a connected lower portion thereof, with some of the features or components of the sleeve assembly 200 overlapping in each figure. The sleeve assembly 200 may be similar to the sleeve assembly 102 of FIG. 1, and therefore may be deployed in a wellbore 108 drilled into the subterranean formation 110 for the extraction of hydrocarbons from the wellbore annulus 126 defined between the wellbore 108 and the sleeve assembly 200. As illustrated, the sleeve assembly 200 is depicted as being arranged in an open hole section of the wellbore 108, but those skilled in the art will readily appreciate that the sleeve assembly 200 may equally be deployed in a cased section of the wellbore 108, without departing from the scope of the disclosure.

The sleeve assembly 200 may include a housing 202 coupled or otherwise attached to a top sub 204*a* at an uphole end and coupled or otherwise attached to a bottom sub 204*b* at a downhole end. In at least one embodiment, the sleeve assembly 200 may also include a mid sub 204*c* that generally interposes the bottom sub 204*b* and the housing 202. In some embodiments, the mid sub 204*c* may be considered part of the bottom sub 204*b*. Accordingly, in at least one embodiment, the bottom sub 204*b* is coupled to the downhole end of the housing 202 via interconnection with the mid sub 204*c*. The top and bottom subs 204*a,b* may form part of or otherwise be considered an integral portion of the production tubing 118, and therefore may help facilitate the production of hydrocarbons from the formation 110 to the surface 106 (FIG. 1).

The housing 202 may define one or more flow ports 206 (two shown) which provide fluid communication between the wellbore annulus 126 and the interior of the housing 202 when the sleeve assembly 200 is in an open configuration, as will be discussed in greater detail below. The sleeve assembly 200 may further include an inner sleeve 208*a* and an outer sleeve 208*b*. The inner sleeve 208*a* may be movably arranged or otherwise extend within each of the housing 202 and the top and bottom subs 204*a,b*. At or near an uphole end, the inner sleeve 208*a* may define a plurality of flow slots 210 about its circumference. The flow slots 210 may be equidistantly or randomly spaced from each other about the circumference of the inner sleeve 208*a*. While depicted in FIG. 2A as elongate perforations in the inner sleeve 208*a*, it will be appreciated by those skilled in the art that the flow slots 210 can be defined in any geometric shape, without departing from the scope of the disclosure. The inner sleeve 208*a* may be movable between an open position and a closed position where, when in the open position, the flow slots 210 may be axially aligned, at least generally, with the flow ports 206 defined in the housing 202. Accordingly, as depicted in FIGS. 2A and 2B, the inner sleeve 208*a* is shown in its open position.

Figure 5A:
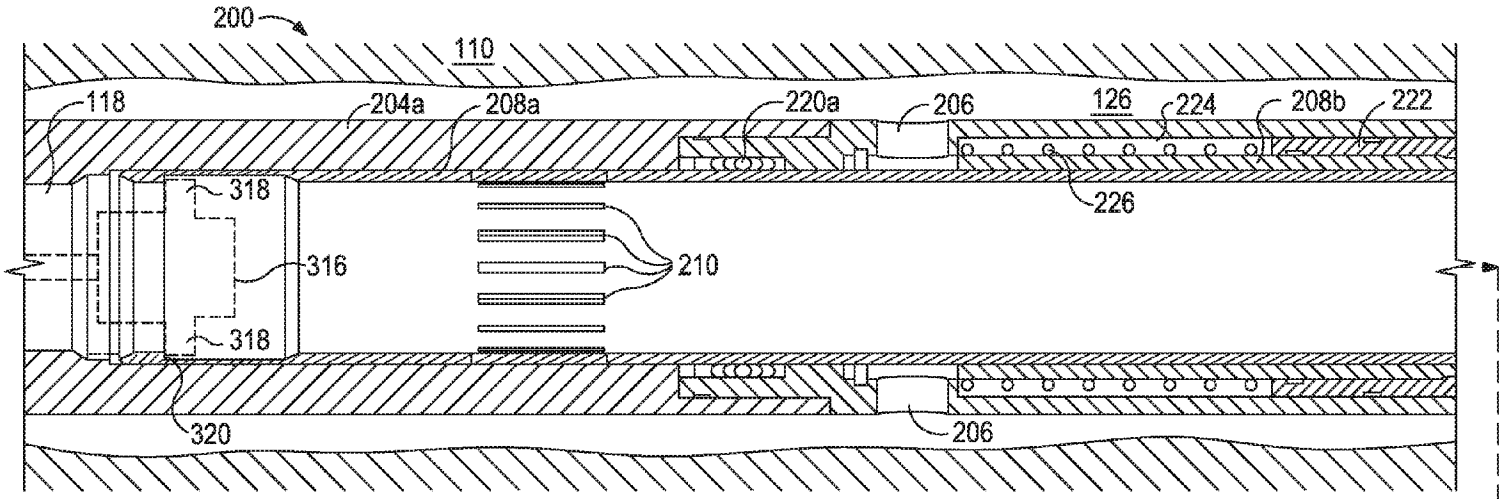
FIGS. 5A and 5B illustrate partial cross-sectional views of the sleeve assembly of FIGS. 2A and 2B as an inner sleeve is moved from its open position into its closed position, according to one or more embodiments.
Figure 5B:
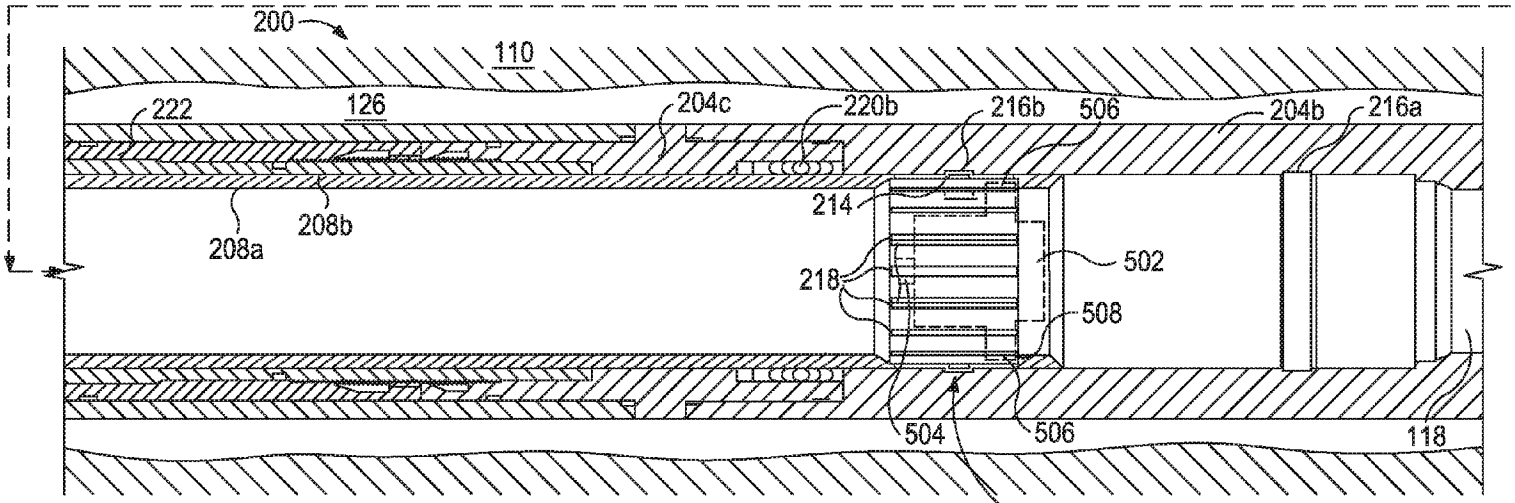

At or near a downhole end, the inner sleeve 208*a* may provide or otherwise define a locking collet 212 configured to lock or otherwise secure the inner sleeve 208*a* in either its open or closed positions. In some embodiments, the locking collet 212 may define one or more locking keys 214 that extend radially from the locking collet 212. The locking keys 214 may be configured to locate and extend into corresponding grooves defined on the inner radial surface of the bottom sub 204*b*, thereby securing the inner sleeve 208*a* against axial movement in either its open or closed positions. Specifically, the bottom sub 204*b* may define a first or lower groove 216*a* and a second or upper groove 216*b*. The lower groove 216*a* may be configured to receive the one or more locking keys 214 in order to lock the inner sleeve 208*a* in its open position (as depicted in FIGS. 2A and 2B). The upper groove 216*b*, however, may be axially offset from the lower groove 216*a* and configured to receive the one or more locking keys 214 in order to lock the inner sleeve 208*a* in its closed position (as depicted in FIGS. 5A and 5B).

While the upper groove 216*b* is shown as being axially offset from the lower groove 216*a* in the uphole direction, embodiments are also contemplated herein where the relative position of the grooves 216*a,b* and their respective functions are reversed. Moreover, additional embodiments are contemplated where the upper and lower grooves 216*a,b* are defined on the top sub 204*a* instead of the bottom sub 204*b*, and the locking collet 212 is otherwise configured to engage or otherwise interact with the grooves 216*a,b* as defined on the top sub 204*a*. For example, in at least one embodiment, the inner sleeve 208*a* may be configured to translate axially in the downhole direction and engage the upper groove 216*b* in order to secure the inner sleeve 208*a* in the closed position. Those skilled in the art will readily recognize several variations of the embodiments disclosed herein that will provide equally similar results.

In at least one embodiment, the locking collet 212 may define one or more longitudinal perforations 218 therein. The longitudinal perforations 218 may be configured to allow the locking collet 212 to flex such that the locking keys 214 are able to move or bend in and out of the corresponding lower and upper grooves 218*a,b* in response to an appropriate amount of axial force applied to the inner sleeve 208*a*.

In some embodiments, the sleeve assembly 200 may also include one or more seals 220*a* and 220*b* configured to prevent unwanted fluid communication between the inner sleeve 208*a* and portions of the housing 202 or mid sub 204*c*. Specifically, a first seal 220*a* may be arranged between the inner sleeve 208*a* and the housing 202 at or near an uphole end of the sleeve assembly 200 and a second seal 220*b* may be arranged between the inner sleeve 208*a* and the mid sub 204*c* (or alternatively the bottom sub 204*b*, in other embodiments) at or near a downhole end of the sleeve assembly 200. The seals 220*a,b* may be useful in preventing unwanted fluid migration when the inner sleeve 208*a* is in either its open or closed positions, or during the transition between the open and closed positions. In some embodiments, the seals 220*a,b* may be v-packing seals (e.g., hydraulic seals). In other embodiments, the seals 220*a,b* may be any other type of seal known to those skilled in the art as suitable in the prevention of fluid migration in downhole environments.

The outer sleeve 208*b* may be radially offset from the inner sleeve 208*a* in a generally concentric or nested relationship, such that the inner sleeve 208*a* may translate axially within the outer sleeve 208*b*. The outer sleeve 208*b* may be otherwise movably arranged within the housing 202 and axially translatable between an open position and a closed position. In embodiments where the sleeve assembly 200 includes the mid sub 204*c*, the outer sleeve 208*b* may also be movably arranged within at least a portion of the mid sub 204*c*. In its closed position, as depicted in FIGS. 2A and 2B, the outer sleeve 208*b* may be configured to substantially occlude or otherwise cover the one or more flow ports 206 defined in the housing 202, thereby preventing fluid communication between the wellbore annulus 126 and the interior of the housing 202. Moreover, in its closed position, the uphole end of the outer sleeve 208*b* may be configured to engage or otherwise bias against a nipple shoulder 209 defined in the interior of the housing 202. The nipple shoulder 209 may prevent the outer sleeve 208*b* from axially translating uphole (i.e., to the left).

The sleeve assembly 200 may further include a piston 222 movably arranged within a piston bore 224 defined in the housing 202. In some embodiments, the piston bore 224 may be cooperatively defined by both the housing 202 and the outer sleeve 208*b*. The piston 222 may be configured to axially translate within the piston bore 224 and a spring 226 may be arranged within the piston bore 224 and configured to engage the piston 222 at its uphole end and thereby bias the piston 222 to the right.

Figure 4:
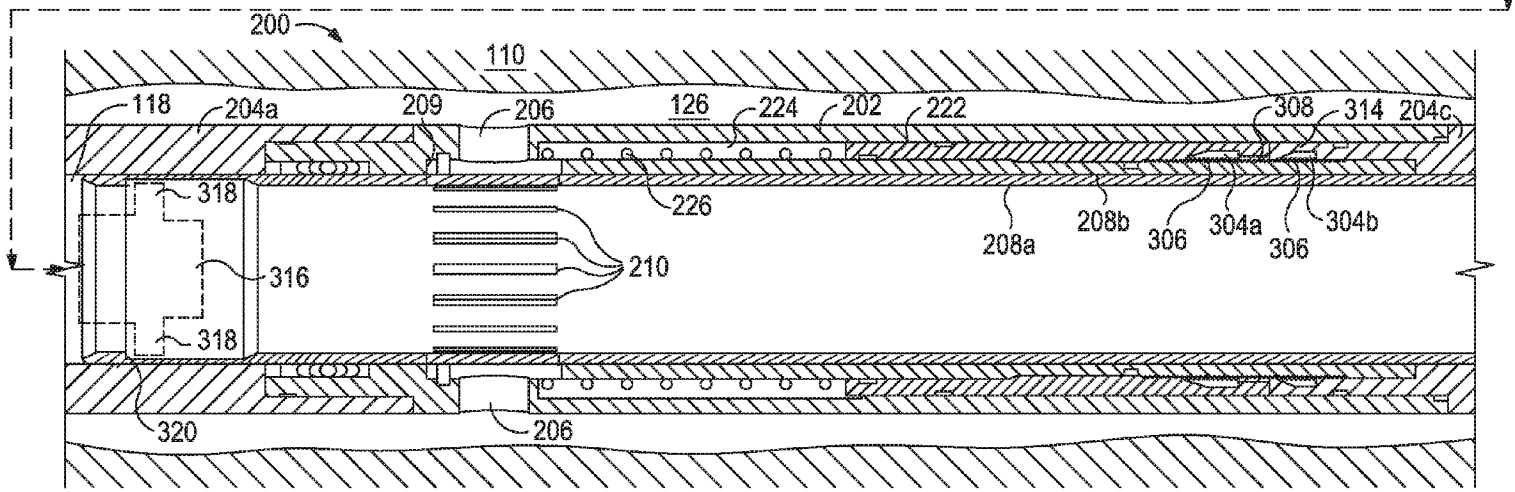
FIG. 4 illustrates a partial cross-sectional view of the sleeve assembly of FIGS. 2A and 2B as an outer sleeve is moved into its open position, according to one or more embodiments.

A piston chamber 228 may be defined between the piston 222 and the outer sleeve 208*b*. In some embodiments, the piston chamber 228 may be cooperatively defined by both the piston 222 and the outer sleeve 208*b*. In at least one embodiment, the piston 222 may be coupled or otherwise attached to the outer sleeve 208*b* using one or more shear pins 230 (one shown). The shear pins 230 may extend at least partially through each of the piston 222 and the outer sleeve 208*b*. In order to move the outer sleeve 208*b* from its closed position to its open position (as depicted in FIGS. 4, 5A and 5B), the shear pins 230 may be sheared with a predetermined amount of force applied to the piston 222.

In at least one embodiment, the force required to shear the shear pins 230 may be obtained by pressurizing the production tubing 118. For example, as the pressure within the production tubing 118 increases, it eventually surpasses the pressure of the wellbore annulus 126 and the pressure within the piston chamber 228, thereby generating a pressure differential across the piston 222. Further increasing the pressure within the production tubing 118 will force the piston 222 to move left (i.e., upward) with respect to the outer sleeve 208*b* (which is biased against the nipple shoulder 209), thereby shearing the shear pins 230 and simultaneously axially collapsing the piston chamber 228.

Figure 3:
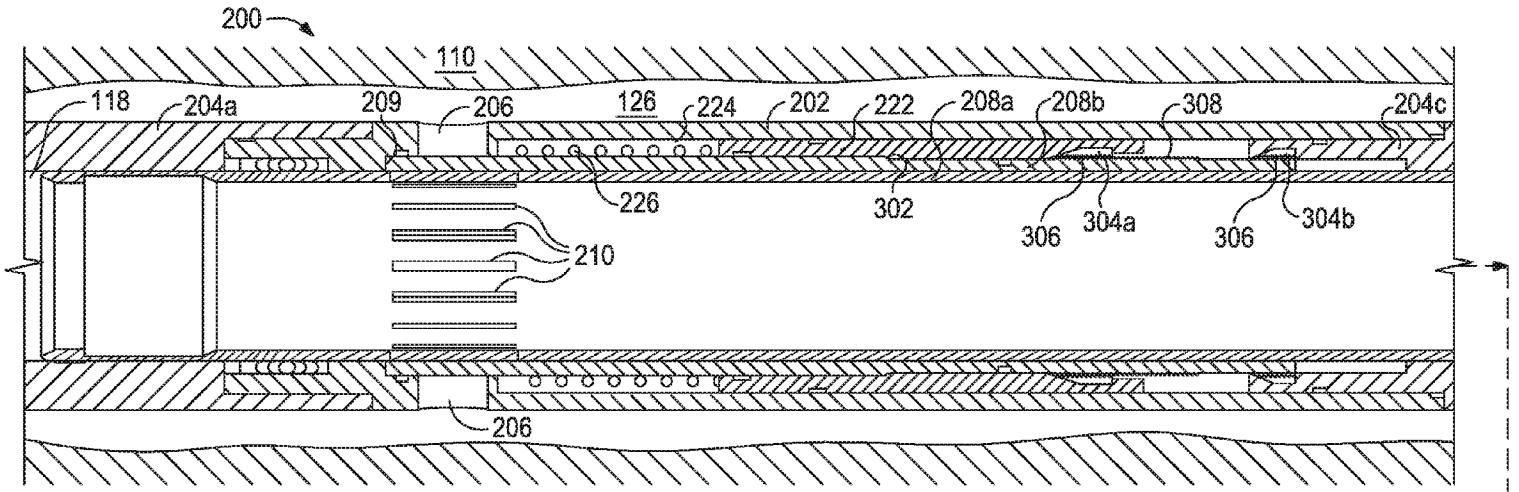
FIG. 3 illustrates a partial cross-sectional view of the sleeve assembly of FIGS. 2A and 2B as a piston is forced to axially translate within a piston bore, according to one or more embodiments.

Referring now to FIG. 3, with continued reference to FIGS. 2A and 2B, illustrated is a partial cross-sectional view of the sleeve assembly 200 as the piston 222 is forced to axially translate within the piston bore 224, according to one or more embodiments. Specifically, FIG. 3 illustrates the piston 222 as it has been forced to move axially from a first position within the piston bore 224, as shown in FIG. 2A, to the left (i.e., upward) and to a second position, as shown in FIG. 3. As the piston 222 moves axially to the left (i.e., upward) within the piston bore 224, the piston chamber 228 (FIG. 2A) collapses until the piston engages a shoulder 302 defined on the outer sleeve 208*b*. Moreover, as the piston 222 moves axially to the left (i.e., upward) within the piston bore 224, the piston 222 also engages the spring 226 and overcomes its spring force and the pressure of the annulus 126, thereby axially compressing the spring 226 within the piston bore 224 in the same direction.

The sleeve assembly 200 may further include a first or upper locking device 304*a* and a second or lower locking device 304*b*. The upper locking device 304*a* may be arranged within the piston bore 224 and otherwise configured to interact with the piston 222 and the outer radial surface of the outer sleeve 208*b*. The lower locking device 304*b* may also be arranged within the piston bore 224, but otherwise configured to interact with the mid sub 204*c* and the outer radial surface of the outer sleeve 208*b*. In some embodiments, the upper locking device 304*a* may be arranged or otherwise captured within a cavity defined in the piston 222 and the lower locking device 304*b* may be arranged or otherwise captured within a cavity defined within the mid sub 204*c* (e.g., considered part of the bottom sub 204*b*).

In at least one embodiment, the upper and lower locking devices 304*a,b* may be beveled c-rings configured to extend about at least a portion of the circumference of the outer sleeve 208*b*. In some embodiments, each of the locking devices 304*a,b* may define a plurality of teeth 306 on their underside (i.e., their respective inner radial surfaces). The teeth 306 may be configured to interact with corresponding teeth 308 defined on the outer radial surface of the outer sleeve 208*b*. For example, as the piston 222 moves axially to the left (i.e., upward) within the piston bore 224, the upper locking device 304*a* moves concurrently therewith since it is captured within the cavity defined in the piston 222. As the upper locking device 304*a* moves axially to the left, its teeth 306 may be configured to move or otherwise bounce over the teeth 308 of the outer sleeve 208*b* or otherwise not cause a binding engagement therewith. On the other hand, if moving in the opposite direction (i.e., axially to the right or downward within the piston bore 224), the teeth 306 of the upper locking device 304*a* may further be configured to engage or otherwise bind against the teeth 308 of the outer sleeve 208*b*.

Referring now to FIG. 4, with continued reference to FIGS. 2A-B and 3, illustrated is a partial cross-sectional view of the sleeve assembly 200 as the outer sleeve 208*b* is moved into its open position, according to one or more embodiments. Specifically, in at least one embodiment, the outer sleeve 208*b* may be moved to the open position by decreasing the fluid pressure within the production tubing 118. Decreasing the pressure in the production tubing 118 removes the pressure differential previously generated across the piston 222, thereby allowing the spring 226 to expand and axially force the piston 222 back to the right (i.e., downward) within the piston bore 224. The piston 222 is also forced to the right by the fluid pressure derived from the annulus 126. The spring 226 may force the piston 222 axially to the right within the piston bore 224 until the downhole end of the piston 222 engages a pin nose 314 defined on the mid sub 204*c* and thereby stops its axial movement.

As the piston 222 moves axially to the right (i.e., downward), as briefly stated above, the teeth 306 of the upper locking device 304*a* may be configured to engage or otherwise bind against the teeth 308 of the outer sleeve 208*b*, thereby forcing the outer sleeve 208*b* also to translate axially to the right (i.e., downward) and into its open position. In the open position, the outer sleeve 208*b* may be configured to uncover the flow ports 206 defined in the housing 202, thereby exposing the flow ports 206 to the flow slots 210 defined in the inner sleeve 208*a* and allowing fluid communication between the wellbore annulus 126 and the production tubing 118.

In one or more embodiments, the lower locking device 304*b* may be configured to lock the outer sleeve 208*b* in the open position. For instance, as the outer sleeve 208*b* moves axially to the right, the teeth 306 of the lower locking device 304*b* may be configured to move or otherwise bounce over the teeth 308 of the outer sleeve 208*b* or otherwise not cause a binding engagement therewith. The teeth 306 of the lower locking device 304*b*, however, may further be configured to engage or otherwise bind against the teeth 308 of the outer sleeve 208*b* in the event the outer sleeve is forced in the opposite direction (i.e., axially to the left within the piston bore 224). As a result, the lower locking device 304*b* secures the outer sleeve 208*b* in the open position such that it will not inadvertently close again.

The sleeve assembly 200 is depicted in FIG. 4 in its open configuration. In the open configuration, production operations can be undertaken in order to extract the hydrocarbons present in the surrounding subterranean formation 110. As briefly mentioned above, however, at least one of the advantages of the exemplary sleeve assembly 200 is the incorporation of the inner sleeve 208*a* which may be useful in reclosing the sleeve assembly 200 if desired. In some applications, an operator may want to reclose the sleeve assembly 200 in order to cease production from that particular location, or to allow pressure testing to be undertaken in the production tubing 118. In other applications, the operator may want to reclose the sleeve assembly 200 in order to isolate certain sections of the production tubing 118 where it would otherwise be disadvantageous to do so while having fluid communication through open flow ports 206 in the sleeve assembly 200.

To reclose the sleeve assembly 200, or otherwise place the sleeve assembly 200 in a closed configuration, the inner sleeve 208*a* may be configured to be moved from its open position, as shown in FIGS. 2A-B, 3, and 4, and into its closed position, as shown in FIGS. 5A and 5B. In some embodiments, this may be accomplished by introducing a shifting tool 316 (shown in phantom in FIG. 4) into the production tubing 118 and run to the sleeve assembly 200. In some embodiments, the shifting tool 316 is run in hole via wireline (not shown), or any other suitable conveyance. In at least one embodiment, the shifting tool 316 may have one or more radial keys or arms 318 configured to extend radially from the shifting tool 316 and locate or otherwise engage a radial shoulder 320 defined on the inner sleeve 208*a*. In some embodiments, the radial arms 318 may be spring loaded. In other embodiments, however, the radial arms 318 may be mechanically, electromechanically, or hydraulically actuated. While the shifting tool 316 has been described herein as having a particular configuration, those skilled in the art will readily recognize that many variations of the shifting tool 316 may be used to engage and shift the inner sleeve 208*a*, without departing from the scope of the disclosure.

Once the shifting tool 316 is properly engaged with the radial shoulder 320 of the inner sleeve 208*a*, the shifting tool 316 may then be "jarred" upwards, i.e., towards the left in FIG. 4 or otherwise towards the surface 106 (FIG. 1). As known by those skilled in the art, jarring upwards refers to an upward impulse of force that is applied to an element, such as in this case the shifting tool 316. Jarring upwards on the shifting tool 316 as engaged with the radial shoulder 320 may force the inner sleeve 208*a* to also move axially to the left within the production tubing 118, thereby shifting the inner sleeve 208*a* from its open position into its closed position.

Referring now to FIGS. 5A and 5B, with continued reference to FIGS. 2A-B, 3, and 4, illustrated are partial cross-sectional views of the sleeve assembly 200 as the inner sleeve 208*a* is moved from its open position into its closed position, according to one or more embodiments. Specifically, FIG. 5A illustrates the upper portion of the sleeve assembly 200 and FIG. 2B illustrates a connected lower portion thereof, with some of the features of the sleeve assembly 200 overlapping in each figure.

In order to axially move the inner sleeve 208*a* to the left within the production tubing 118, and therefore into its closed position, the jarring of the shifting tool 316 may be configured to overcome the locking engagement between the locking collet 212 and the lower groove 216*a*. In particular, the shifting tool 316 may be jarred sufficiently such that the locking keys 214 flex inwards and out of engagement with the lower groove 216*a*. Once out of engagement with the lower groove 216*a*, the locking keys 214 may be able to slide along the inner radial surface of the bottom sub 204*b* as the inner sleeve 208*a* moves axially to the left and towards its closed position. Upon locating or otherwise engaging the upper groove 216*b*, the locking keys 214 may be configured to once again flex outwards and into engagement with the upper groove 216*b*, thereby securing the inner sleeve 208*a* in the closed position.

With the inner sleeve 208*a* in its closed position, the flow slots 210 are no longer exposed to the flow ports 206. Instead, the flow ports 206 are generally occluded by the wall of the inner sleeve 208*a*, thereby preventing fluid communication between the wellbore annulus 126 and the production tubing 118, and effectively ceasing fluid production at the location of the sleeve assembly 200. Accordingly, FIGS. 5A and 5B depict the sleeve assembly 200 in a closed configuration.

One of the advantages of the exemplary sleeve assembly 200 is that the locking engagement between the upper groove 216*b* and the locking keys 214 may prevent the inner sleeve 208*a* from inadvertently moving back into its open position. In some applications, however, an operator may want to recommence production at the sleeve assembly 200 at a later time, thereby requiring the inner sleeve 208*a* to move back into its open position and the sleeve assembly 200 back into its open configuration. To accomplish this, in some embodiments, a shifting tool 502 (shown in phantom in FIG. 5B) may be introduced into the production tubing 118 and run to the sleeve assembly 200 via wireline 504 or other suitable conveyance means. In some embodiments, the shifting tool 502 may be similar to or the same as the shifting tool 316 shown in FIGS. 4 and 5A. In other embodiments, however, the shifting tool 502 may be any suitable shifting tool known to those skilled in the art.

In at least one embodiment, the shifting tool 502 may have one or more radial keys or arms 506 configured to extend radially from the shifting tool 502 and locate or otherwise engage a radial shoulder 508 defined on the inner sleeve 208*a*. In one embodiment, the radial shoulder 508 may be defined on the inner radial surface of the locking collet 212 of the inner sleeve 208*a*. Once the shifting tool 502 is properly engaged with the radial shoulder 508, the shifting tool 502 may then be jarred downwards, i.e., towards the right in FIG. 5B or otherwise towards the toe of the well. As known by those skilled in the art, jarring downwards refers to a downward impulse of force that is applied to an element, such as in this case the shifting tool 502. Jarring downwards on the shifting tool 502 as engaged with the radial shoulder 508 may force the inner sleeve 208*a* to move axially to the right within the production tubing 118, and thereby back towards its open position.

In order to axially move the inner sleeve 208*a* to the right within the production tubing 118, however, the jarring of the shifting tool 502 must overcome the locking engagement between the locking collet 212 and the upper groove 216*b*. In particular, the shifting tool 502 may be jarred sufficiently such that the locking keys 214 flex inwards and out of engagement with the upper groove 216*b*. Once out of engagement with the upper groove 216*b*, the locking keys 214 may be able to slide along the inner radial surface of the bottom sub 204*b* as the inner sleeve 208*a* moves axially to the right and back towards its open position. Upon locating or otherwise engaging the lower groove 216*a*, the locking keys 214 may be configured to once again flex outwards and into engagement with the lower groove 216*a*, thereby securing the inner sleeve 208*a* in the closed position.

Accordingly, it will be appreciated by those skilled in the art that the sleeve assembly 200 may be opened and closed multiple times. This provides a distinct and valuable advantage over prior art sleeve assemblies which oftentimes provide a permanent fixation in either the open or closed configurations.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A sleeve assembly, comprising:

a housing having an uphole end and a downhole end and defining one or more flow ports that provide fluid communication between a wellbore annulus and an interior of the housing, the housing being coupled to a top sub at the uphole end and to a bottom sub at the downhole end;

an outer sleeve arranged within the housing and movable between a closed position, where the outer sleeve occludes the one or more flow ports, and an open position, where the one or more flow ports are exposed;

an inner sleeve concentrically arranged within the outer sleeve and defining a plurality of flow slots, the inner sleeve being movable between an open position and a closed position where, when in the open position, the plurality of flow slots are axially aligned with the one or more flow ports;

a piston movably arranged within a piston bore defined in the housing; and an upper locking device arranged within a first cavity defined in the piston and, movable therewith, the upper locking device being engageable with an outer radial surface of the outer sleeve.

2. The sleeve assembly of claim 1, further comprising:

a spring arranged within the piston bore and configured to bias an uphole end of the piston, wherein as the spring biases against and axially moves the piston within the piston bore, the upper locking device engages and simultaneously moves the outer sleeve into the open position of the outer sleeve.

3. The sleeve assembly of claim 2, further comprising:

a plurality of teeth defined on an inner radial surface of the upper locking device; and a plurality of corresponding teeth defined on the outer radial surface of the outer sleeve, wherein, when the spring biases against and axially moves the piston, the plurality of teeth of the upper locking device bind against the plurality of corresponding teeth of the outer sleeve, thereby moving the outer sleeve into the open position of the outer sleeve.

4. The sleeve assembly of claim 2, further comprising a lower locking device arranged within a second cavity defined in the bottom sub, the lower locking device being configured to secure the outer sleeve in the open position of the outer sleeve.

5. The sleeve assembly of claim 4, further comprising a plurality of teeth defined on an inner radial surface of the lower locking device; and a plurality of corresponding teeth defined on the outer radial surface of the outer sleeve, wherein, when the outer sleeve is in the open position, the plurality of teeth of the lower locking device bind against the plurality of corresponding teeth of the outer sleeve, thereby securing the outer sleeve into the open position.

6. The sleeve assembly of claim 3, further comprising a locking collet provided on the inner sleeve and being configured to secure the inner sleeve in either the open or closed positions.

7. The sleeve assembly of claim 6, further comprising:

one or more locking keys extending radially from the locking collet;

a first groove defined on an inner radial surface of the bottom sub; the one or more locking keys being configured to engage the first groove in order to lock the inner sleeve in the open position; and a second groove defined on the inner radial surface of the bottom sub, the one or more locking keys being configured to engage the second groove in order to lock the inner sleeve in the closed position.

8. The sleeve assembly of claim 7, further comprising one or more longitudinal perforations defined in the locking collet, the longitudinal perforations being configured to allow the locking collet to flex such that the one or more locking keys is able to move in and out of the first and second grooves.

9. The sleeve assembly of claim 3, further comprising a shifting tool engageable with a radial shoulder defined on the inner sleeve, the shifting tool being configured to move the inner sleeve between the open and closed positions of the inner sleeve.

10. A method of actuating a sleeve assembly installed in production tubing, the method comprising:

introducing a first shifting tool into the sleeve assembly, the sleeve assembly including a housing defining one or more flow ports, an outer sleeve arranged within the housing such that the one or more flow ports are exposed, a piston movably arranged within the housing, and an inner sleeve concentrically arranged within the outer sleeve and defining a plurality of flow slots, wherein the plurality of flow slots are axially-aligned with the one or more flow ports, thereby providing fluid communication between a wellbore annulus and an interior of the sleeve assembly, engaging an outer radial surface of the outer sleeve and moving the outer sleeve with an upper locking device arranged within a first cavity defined in the piston and movable therewith, the upper locking device moving the outer sleeve so as to expose the one or more flow ports and provide the fluid communication between the wellbore annulus and the interior of the sleeve assembly;

engaging the first shifting tool on a first radial shoulder defined on the inner sleeve; and axially moving the inner sleeve with the first shifting tool such that the plurality of flow slots are moved out of axial alignment with the one or more flow ports.

11. The method of claim 10, wherein the inner sleeve further includes a locking collet having one or more locking keys extending radially therefrom, and axially moving the inner sleeve further comprises forcing the one or more locking keys out of engagement with a first groove defined on an inner radial surface of the production tubing.

12. The method of claim 11, further comprising:

engaging the one or more locking keys in a second groove defined on the inner radial surface of the production tubing, the second groove being axially offset from the first groove; and locking the inner sleeve in an axial position with the plurality of flow slots moved out of axial alignment with the one or more flow ports.

13. The method of claim 12, further comprising:

introducing a second shifting tool into the sleeve assembly;

engaging the second shifting tool on a second radial shoulder defined on the inner sleeve; and axially moving the inner sleeve with the second shifting tool such that the plurality of flow slots are moved back into axial alignment with the one or more flow ports.

14. The method of claim 13, wherein axially moving the inner sleeve with the second shifting tool further comprises:

forcing the one or more locking keys out of engagement with the second groove;

engaging the one or more locking keys once more in the second groove; and locking the inner sleeve in the axial position with the plurality of flow slots axially aligned with the one or more flow ports.

15. The method of claim 11, preceded by the following steps:

increasing a pressure within the sleeve assembly;

generating a pressure differential across the piston;

forcing the piston to move axially within the piston bore from a first position to a second position, thereby axially compressing a spring arranged within the piston bore;

reducing the pressure within the sleeve assembly; and forcing the piston with the spring back to the first position.

16. The method of claim 15, wherein generating the pressure differential across the piston further comprises collapsing a piston chamber defined between the piston and the outer sleeve.

17. The method of claim 16, wherein forcing the piston to move axially within the piston bore from the first position further comprises shearing one or more shear pins used to couple the piston to the outer sleeve.

18. A sleeve assembly, comprising:

a housing defining one or more flow ports that provide fluid communication between a wellbore annulus and an interior of the housing, the housing being configured to be coupled at each end to production tubing;

an outer sleeve arranged within the housing and movable between a closed position, where the outer sleeve occludes the one or more flow ports, and an open position, where the one or more flow ports are exposed;

an inner sleeve concentrically arranged within the outer sleeve and defining a plurality of flow slots, the inner sleeve being movable between an open position and a closed position where, when in the open position, the plurality of flow slots are axially aligned with the one or more flow ports;

a piston movably arranged within a piston bore defined in the housing;

a spring arranged within the piston bore and configured to bias an uphole end of the piston; and an upper locking device arranged within a first cavity defined in the piston and movable therewith, the upper locking device being engageable with an outer radial surface of the outer sleeve such that as the spring biases against and axially moves the piston within the piston bore, the upper locking device engages and simultaneously moves the outer sleeve into the open position of the inner sleeve.

19. The sleeve assembly of claim 18, further comprising a locking collet provided on the inner sleeve and being configured to secure the inner sleeve in either the open or closed positions.

20. The sleeve assembly of claim 19, further comprising:

one or more locking keys extending radially from the locking collet;

a first groove defined on an inner radial surface of the production tubing, the one or more locking keys being configured to engage the first groove in order to lock the inner sleeve in the open position; and a second groove defined on the inner radial surface of the production tubing and axially offset from the first groove, the one or more locking keys being configured to engage the second groove in order to lock the inner sleeve in the closed position.

* * * * *